United States Patent [19]

Caldwell et al.

[11] Patent Number: 4,842,439

[45] Date of Patent: Jun. 27, 1989

[54] LABEL SUPPLY COLLET-CLAMP FITTING

[75] Inventors: Edward D. Caldwell, Seattle; Pamela M. Koury, Lynnwood, both of Wash.

[73] Assignee: Intermec Corporation, Lynnwood, Wash.

[21] Appl. No.: 63,168

[22] Filed: Jun. 17, 1987

[51] Int. Cl.[4] ..... B25G 3/24

[52] U.S. Cl. ..... 403/290; 403/349; 285/395

[58] Field of Search ..... 403/348, 290, 349; 279/6, 51, 1 TE; 285/395, 359, 360, 401

[56] References Cited

U.S. PATENT DOCUMENTS

| | | | |
|---|---|---|---|
| 557,645 | 4/1896 | Blessing | 403/348 X |
| 1,474,586 | 11/1923 | Hanrahan | 285/401 X |
| 3,034,798 | 5/1962 | Portz | 403/290 X |
| 3,321,863 | 5/1967 | Maxam, Jr. | 403/290 X |

FOREIGN PATENT DOCUMENTS

| | | | |
|---|---|---|---|
| 627 | of 1883 | United Kingdom | 403/348 |
| 1047869 | 11/1966 | United Kingdom | 403/290 |

*Primary Examiner*—Andrew V. Kundrat

*Attorney, Agent, or Firm*—Seed and Berry

[57] ABSTRACT

A collet-clamp for retaining label supply rolls on a dispensing shaft. The collet has a plurality of fingers that can be tightened against the shaft when the clamp is moved axially toward the collet. The base of the collet supports a plurality of helical wedging surfaces that cooperate with annular segments formed on the axial hub of the clamp in order to cause the clamp to be brought closer to the collet when the clamp is twisted in a predetermined clamping direction with respect to the collet. The collet and clamp are assembled by bringing the annular segments of the clamp into cooperative engagement with the helical wedging surfaces of the collet by twisting the clamp with respect to the collet in the direction opposite the clamping direction prior to placing the collet-clamp fitting onto the shaft. While on the shaft the collet-clamp fitting cannot be disassembled.

21 Claims, 2 Drawing Sheets

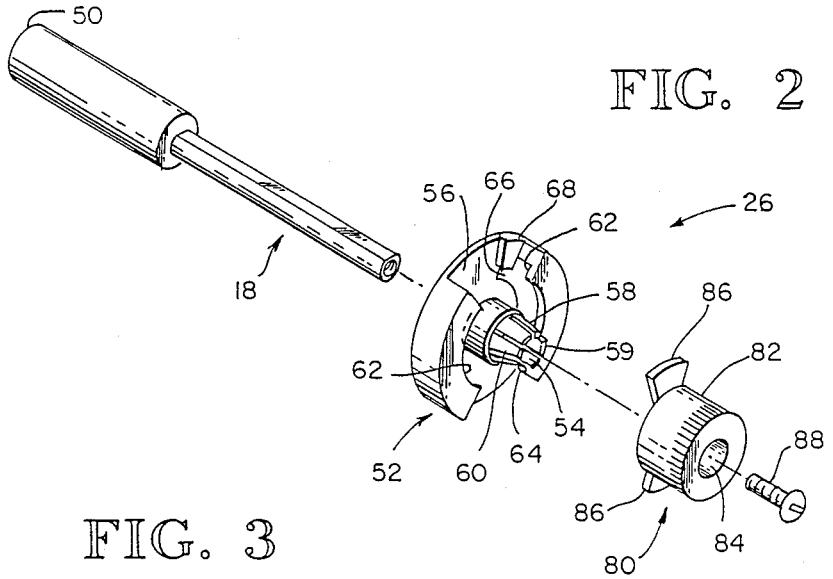
FIG. 2
FIG. 3
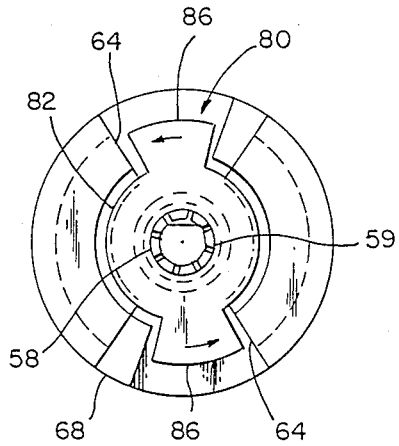
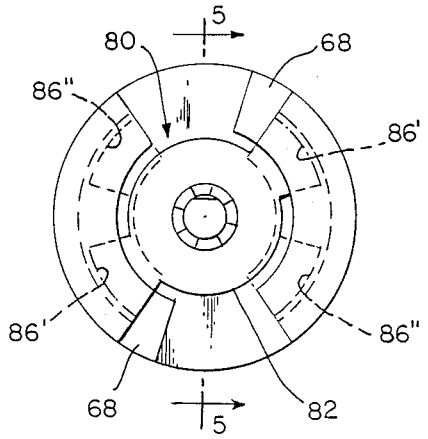
FIG. 4
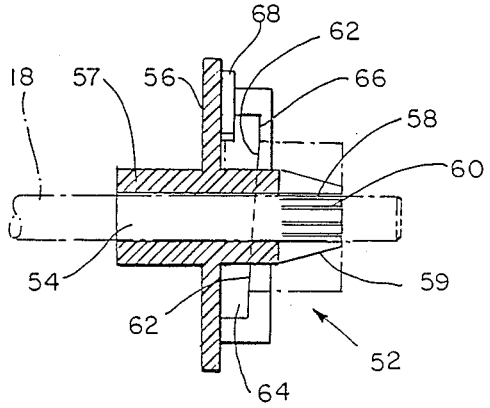
FIG. 5

LABEL SUPPLY COLLET-CLAMP FITTING

TECHNICAL FIELD OF THE INVENTION

The present invention relates to a collet-clamp fitting, and more particularly, to a continuously adjustable collet-clamp fitting for retaining rolled label supplies on a shaft.

BACKGROUND ART

Flexible printing stock is commonly supplied in the form of rolls formed around a cylindrical core. The flexible stock supplied on these rolls can be dispensed from the core while the core is supported by a horizontal shaft. While so supported, the roll can move axially with respect to the shaft, thereby causing problems if the flexible stock is being fed to a machine having low tolerance to printing stock misalignments. Many types of printers have a low tolerance to such misalignments.

In order to overcome the alignment problem, it is possible to closely confine the axial movement of the core carrying the flexible stock by mechanically defining axial limits outside which the flexible stock core will not be allowed to pass. Such a method works adequately if the width of the rolls of flexible stock is substantially constant. However, if it is possible that the flexible stock can be supplied on any of a number of standard roll widths, either a number of shafts, one for each of the standard widths, must be supplied or else the axial end limits must be discretely adjustable.

In situations where, for example, the roll can come in random widths or the position of the roll on the shaft must be continuously adjustable, such approaches are of no avail.

Prior art solutions to the variable-width label stock problem have used a collet in conjunction with an internally threaded screw-on nut to clamp the collet in place. A collet-clamp fitting of this type is difficult to manufacture because it is necessary to machine the threads on the outer surface of the collet and on the inner surface of the nut. Further, in order to prevent the collet and nut from being separated once assembled, assembly requires the inclusion of a stop device. The likelihood that the collet and the nut could become separated is increased where, as in the prior art, the collet and clamp nut can be disassembled by twisting them in the same relative directions as is required to loosen the collet-nut fitting.

DISCLOSURE OF THE INVENTION

It is an object of the present invention to provide a collet-clamp fitting that does not require a threading operation, thereby making it easy to manufacture.

It is another object of the present invention to provide a collet-clamp fitting composed of two parts that can be manufactured separately and assembled in a configuration that does not readily disassemble.

It is a further object of the present invention to provide a collet-clamp fitting that can be assembled while not on the shaft by a relative twisting motion in a first direction and clamped onto the shaft by a relative twisting motion in the direction opposite the first direction.

In general, such a fitting comprises an axial collet having a first plurality of axially tapered fingers that can be pliably urged against the shaft. The first plurality of fingers is connected to a base supporting a second plurality of helical wedging surfaces. The fitting further includes a finger-tightenable clamp having an inner surface that forces the first plurality of fingers of the clamp against the shaft when the clamp is moved axially toward the collet, and a second plurality of surfaces that bear against the helical wedging surfaces of the collet and cause the clamp to move axially toward the collet when the clamp is twisted axially in a predetermined clamping direction with respect to the collet. In particular, the collet-clamp of the present invention includes a collet and clamp that can be engaged in assembly by an axial twisting motion of the clamp with respect to the collet in the direction opposite the clamping direction. Assembly and disassembly of the collet-clamp fitting can only be accomplished when the collet-clamp fitting is removed from the shaft.

BRIEF DESCRIPTION OF THE DRAWINGS

FIG. 2 is an exploded view of the collet-clamp fitting of the present invention and the shaft to which it is attached.

FIG. 3 is an elevational view of the collet-clamp fitting, showing the collet and clamp in the first assembly position.

FIG. 4 is an elevational view of the collet-clamp fitting, showing the assembled fitting in fully open and fully clamped positions.

FIG. 5 is a cross-sectional view of the clamp taken along the lines of FIG. 4 and showing the wedging action that causes the clamp to be moved axially toward the collet when the clamp is twisted with respect to the collet.

BEST MODE FOR CARRYING OUT THE INVENTION

Figure 1:
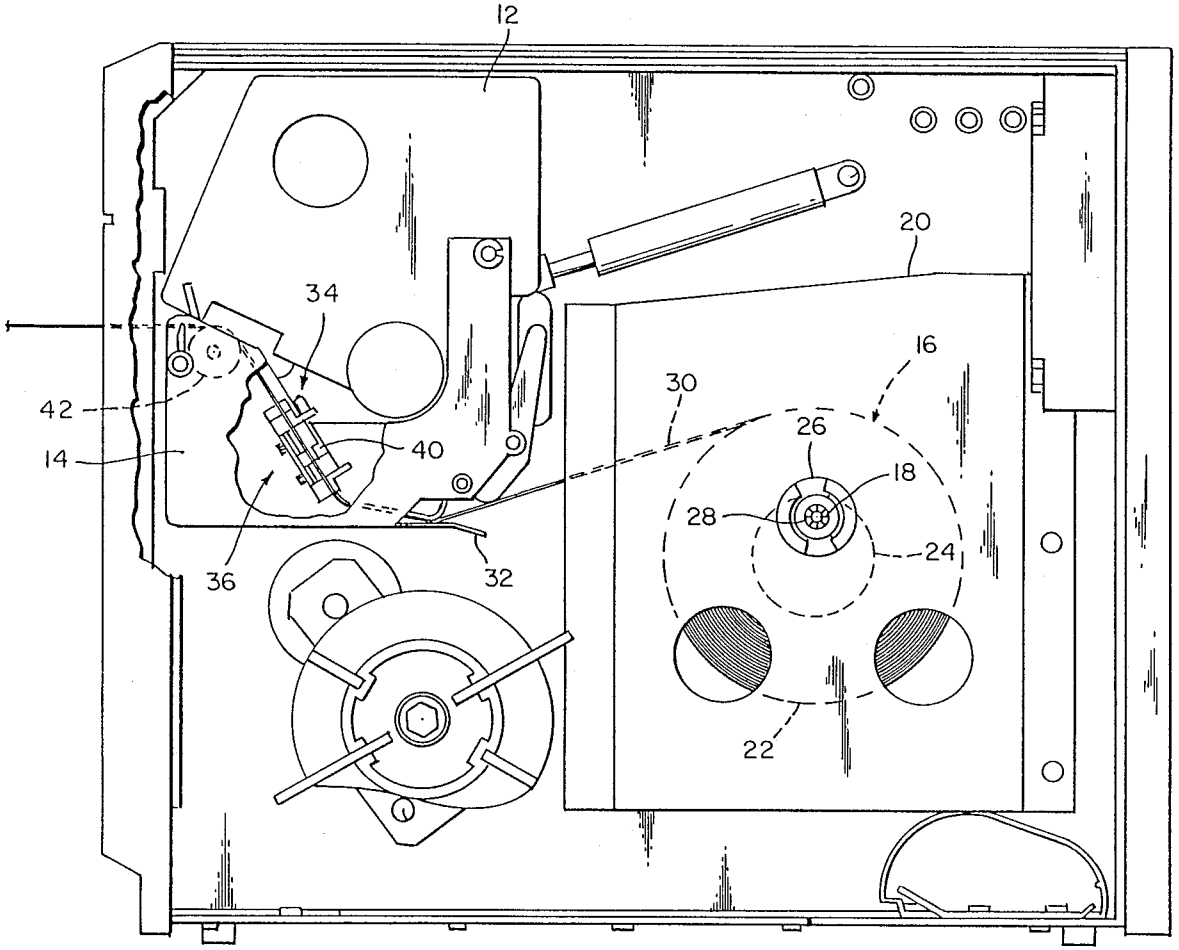
FIG. 1 is a side elevational view of a thermal transfer printer showing the label stock path through the machine and the collet-clamp fitting of the present invention.

FIG. 1 is a side elevational view of a thermal transfer printer, showing a label stock path and the collet-clamp fitting in its installed position. Printer 10 consists of a ribbon module 12, a paper module 14 and label supply apparatus 16. Ribbon module 12 carries a thermal transfer ribbon having a polyester backing and a waxy ink past a thermal printhead capable of producing small rectangular areas of intense heat which can melt the waxy ink in a local area of the transfer ribbon.

Label supply apparatus 16 consists of a shaft 18 projecting horizontally outward from a vertical plate 20. Label supply roll 22, which typically consists of adhesive label blanks attached to a backing paper and wound around a cardboard core 24, is supported from shaft 18.

The inboard ends of roll 22 and core 24 are adjacent to plate 20 and are restricted from moving out of the plane of FIG. 1 by label supply collet-clamp 26. Collet-clamp 26 is retained on shaft 18 by retaining screw 28. Collet-clamp 26 is adjusted against the outboard ends of roll 22 and core 24 to restrict the axial movement of the roll and core in order that the label stock 30 will be fed, within acceptable tolerances, into paper module 14. Label stock 30 leads from the upper edge of label supply roll 22 past edge guide 32 and into paper path 34.

Paper path 34 contains an optical sensing apparatus 36 including light-emitting diode (LED) 38 and light sensor 40. The optical sensing apparatus, by means of circuitry not shown, senses the changing opacity of the passing label stock 30. The instantaneous opacity depends upon whether there is label stock positioned above the optical sensing apparatus 36 and, if there is, whether the label stock consists of only the backing paper or of both the backing paper and an attached label blank. The information generated by optical sensing apparatus 36 is used to synchronize the printer and locate the indicia printed on each label blank. The label stock then passes to roller 42. which is driven by a stepping motor (not shown), and causes the label stock to be adjacent the ink side of the thermal transfer ribbon as the label and ribbon pass together past the printhead contained in ribbon module 12.

To ensure that the printer will work with label supply rolls 22 whose widths vary within specified tolerances, and to allow printer 10 to operate with label supply rolls of random widths, label supply collet-clamp 26 should be continuously adjustable along shaft 18. The inner diameter of cardboard core 24 is greater than the outer diameter of label supply collet-clamp 26 so that a label supply roll can be replaced, generally without the need to adjust collet-clamp 26 if the same size roll is used.

FIG. 2 is an exploded view of the label supply shaft 18 and collet-clamp 26. The first end 50 of shaft 18 is fastened to plate 20 (see FIG. 1), and shaft 18 assumes a horizontal position that is perpendicular to the intended direction of travel of label stock 30 through paper path 34. The portion of shaft 18 nearest first end 50 has a circular cross section, while a portion of shaft 18 disposed away from first end 50 has a "D" cross section. The axial length of the circular cross-sectional portion of shaft 18 is less than the smallest width of label supply roll that is to be used with the printer. The collet portion 52 of collet-clamp 26 has an axial D-shaped inner hole 54 that is only slightly larger than the outer dimensions of the "D" cross-sectional portion of shaft 18. This D-shaped hole prevents collet 52 from rotating with respect to shaft 18. One part of axial inner hole 54 passes through base 56 and label roll support flange 57 of collet 52, while another portion passes through end 58, which comprises a plurality of annularly arranged, pliable fingers 60. Label roll support flange 57 has a circular cross-section of the same outer diameter as the circular portion of shaft 18, so the label roll is held horizontally, regardless of its width. The outer surface 59 of the plurality of pliable fingers 60 is axially (e.g., conically) tapered in the direction of the fingers. By urging the inner surface of pliable fingers 60 against the outer surface of the "D" cross-sectional area of shaft 18, collet 52 can be fixed in any position along the D-shaped portion of shaft 18.

Base 56 also supports at least two helical wedging surfaces 62, each having an open end 64 and a stopped end 66 defined by the adjacent positioning of stop 68 located on base 56. The axial thickness of a helical wedging surface 62 is greater at open end 64 than it is at stopped end 66. In other words, the helical wedging surfaces 62, shown in FIG. 2, have a right-hand screw orientation. If desired, of course, wedging surfaces 62 could be given a left-hand screw orientation. Stop 68 serves to capture clamp 80 to collet 52 after they have been assembled.

Clamp 80 is an axial member consisting of a finger-tightenable hub 82 having an outwardly tapering (e.g., conical) inner surface 84 and a plurality of annular segments 86, the number of annular segments equaling the number of helical wedging surfaces in collet 52. The inner surface 84 is only slightly larger than the outer surface of pliable fingers 60 on collet 52. Accordingly, as hub 82 is placed over fingers 60 and then forced in the direction toward collet 52, pliable fingers 60 are forced radially inward. If collet 52 is mounted on a shaft, such as shaft 18, this radial motion of pliable fingers 60 will clamp collet 52 against shaft 18.

The angular extent of each annular segment 86 is less than the angular separation between adjacent open end 64 and stop 68 of adjacent helical wedging surfaces 62. Accordingly, as shown in FIG. 3 and supplemented by FIG. 5, clamp 80 can be assembled with collet 52 with the collet-clamp fitting off of the shaft, by orienting annular segments 86 into the annular gap between adjacent helical wedging surfaces 62 of collet 52. Assembly is completed by twisting clamp 80 so that annular segments 86 enter the open ends of the corresponding helical wedging surfaces 62 (counterclockwise in FIG. 3). As shown in phantom line outline in FIG. 4, annular segments 86' of clamp 80 cannot be twisted past stop 68, thereby capturing clamp 80 to collet 52 in a fully open position. In the preferred embodiment, the adjacent surfaces of the annular segments are given a helical twist of the same handedness as helical wedging surfaces 62. The positions and sizes of inner surface 84, annular segment 86, pliable fingers 60 and helical wedging surfaces 62 are arranged so that the collet and clamp cannot be assembled while the collet is in place on a shaft 18. After assembly, the collet-clamp 26 can be placed on the "D" cross section portion of shaft 18.

By twisting clamp 80 in the clamping direction (opposite that required to assemble collet-clamp 26), clamp 80 is wedged into closer proximity to base 56 of collet 52 by helical surfaces 62. In accordance with this motion, pliable fingers 60 are urged with increasing force against the outer surface of "D"-cross-section-shaped shaft 18. Inner surface 84, annular segment 86, fingers 60 and wedging surfaces 62 are further arranged so that a full clamp load is reached by collet-clamp 26 before clamp 80 becomes disengaged from collet 52. For a given collet-clamp fitting, the full clamp load position of clamp 80 is determined by the cross section of the D-shaped portion of shaft 18. One possible full clamp load position of annular segments 86'' of clamp 80 is shown in a dashed outline in FIG. 4.

Referring to FIG. 2, the assembled collet-clamp 26 is continuously adjustable along the "D" cross section portion of shaft 18. To retain collet-clamp 26 on shaft 18, retaining screw 88, whose head is greater than the inner diameter of conical inner surface 84, is screwed into threads formed at the end of shaft 18.

Collet 52 and clamp 80 of the collet-clamp 26 of the present invention can be very simply made using two-part molds. They can be cast from a metal or injection-molded from a plastic, such as Delrin®. No machining operations are required to finish these parts since all of the critical features can be accessed from one axial direction or the other.

While a preferred embodiment of the present invention has been explained in detail, it will be apparent to those skilled in the art that various modifications of this embodiment can be made without departing from the scope and spirit of the invention, which is to be limited only by the following claims.

We claim:

1. A fitting for gripping a shaft, comprising:

a collet having an axis and a plurality of axially tapered fingers that are pliably urgeable against the shaft, the plurality of fingers being connected to a base supporting a plurality of helical wedging surfaces having a predetermined handedness; and a finger-tightenable clamp having an inner surface that forces the plurality of fingers against the shaft when the clamp is moved axially toward the collet, and a plurality of bearing surfaces that bear against the wedging surfaces of the collet and cause the clamp to move axially toward the collet when the clamp is twisted about the collet axis in a predetermined clamping direction, the collet and clamp being engaged in assembly prior to placing the collet-clamp fitting on the shaft by an axial twisting motion of the clamp with respect to the collet in the direction opposite to the clamping direction.

2. The fitting of claim 1 wherein the plurality of bearing surfaces is formed on segments of an annulus.

3. The fitting of claim 2 wherein the plurality of bearing surfaces has the same handedness as the plurality of helical wedging surfaces.

4. A continuously adjustable fitting for gripping a shaft supporting a roll of flexible stock, comprising:

a collet having an axis and a plurality of axially tapered fingers that are pliably urgeable against the shaft, the plurality of fingers being connected to a base supporting a plurality of helical wedging surfaces having a predetermined handedness; and a finger-tightenable clamp having an axis and a hub comprising an inner frustoconical surface that forces the plurality of fingers against the shaft when the clamp is moved axially toward the collet, and a plurality of bearing surfaces that bear against the wedging surfaces of the collet, each bearing surface being a segment of an axial annulus, the collet and clamp being engaged in assembly from a first assembly position by an axial twisting motion of the clamp with respect to the collet in a predetermined assembly direction, and the clamp moving axially toward the collet when the clamp is twisted axially toward the first assembly position in a predetermined clamping direction with respect to the collet, the clamping direction being opposite to the assembly direction.

5. The fitting of claim 4 wherein the plurality of bearing surfaces has the same handedness as the plurality of helical wedging surfaces.

6. The fitting of claim 4 wherein the fingers reach a full clamp load against the shaft before the collet and clamp reach the first assembly position.

7. The fitting of claim 4 wherein the plurality of fingers, the base, and the plurality of helical wedging surfaces of the collet, and the hub and bearing surfaces of the clamp can be accessed along the directions of the axis, so that the collet and clamp can each be cast or injection-molded in a two-part mold.

8. The fitting of claim 4 wherein the collet base further supports an axial roll support flange.

9. The fitting of claim 4 wherein assembly and disassembly can only be accomplished by removing the collet-clamp fitting from the shaft.

10. The fitting of claim 1 wherein the plurality of fingers, the base, and the plurality of helical wedging surfaces of the collet, and the hub and bearing surfaces of the clamp can be accessed along the directions of the axis, so that the collet and clamp can each be cast or injection-molded in a two-part mold.

11. A fitting for gripping a shaft, comprising:

a collet having an axis and a plurality of axially tapered fingers that are pliably urgeable against the shaft, the plurality of fingers being connected to a base supporting a plurality of helical wedging surfaces having a predetermined handedness; and a finger-tightenable clamp having an inner surface that forces the plurality of fingers against the shaft when the clamp is moved axially toward the collet, a plurality of bearing surfaces that bear against the wedging surfaces of the collet and cause the clamp to move axially toward the collet when the clamp is twisted about the collet axis in a predetermined clamping direction, and stop means, the collet and clamp being engaged in assembly prior to placing the collet-clamp fitting on the shaft by an axial twisting motion of the clamp with respect to the collet in the direction opposite to the clamping direction, the stop means preventing the clamp from being twisted beyond a predetermined angular position by the axial twisting motion.

12. The fitting of claim 11 wherein the plurality of bearing surfaces is formed on segments of an annulus.

13. The fitting of claim 12 wherein the plurality of bearing surfaces has the same handedness as the plurality of helical wedging surfaces.

14. The fitting of claim 11 wherein the inner surface of the finger-tightenable clamp is frustoconical.

15. The fitting of claim 10 wherein the plurality of bearing surfaces has the same handedness as the plurality of helical wedging surfaces.

16. The fitting of claim 11 wherein the fingers reach a full clamp load against the shaft before the collet and clamp reach the first assembly position.

17. The fitting of claim 11 wherein the collet base further supports an axial roll support flange.

18. The fitting of claim 11 wherein assembly and disassembly can only be accomplished by removing the collet-clamp fitting from the shaft.

19. A fitting for gripping a shaft having a predetermined cross-sectional shape, comprising:

a collet having an axial inner hole that is complementary to the cross-sectional shape of the shaft and a plurality of axially tapered fingers that are pliably urgeable against the shaft, the plurality of fingers being connected to a base supporting a plurality of helical wedging surfaces having a predetermined handedness; and a finger-tightenable clamp having an inner surface that forces the plurality of fingers against the shaft when the clamp is moved axially toward the collet, a plurality of bearing surfaces that bear against the wedging surfaces of the collet and cause the clamp to move axially toward the collet when the clamp is twisted about the collet axis in a predetermined clamping direction, the collet and clamp being engaged in assembly prior to placing the collet-clamp fitting on the shaft by an axial twisting motion of the clamp with respect to the collet in the direction opposite to the clamping direction.

20. The fitting of claim 19, wherein the shaft has a D-cross sectional shape and the inner hole of the collet has a complementary D-cross sectional shape.

21. The fitting of claim 20 wherein the collet base further supports an axial roll support flange.

* * * * *